US005105943A

United States Patent [19]

Lesko et al.

[11] Patent Number: 5,105,943

[45] Date of Patent: Apr. 21, 1992

[54] WIRE COIL PACKAGE

[75] Inventors: Michael J. Lesko, Bolingbrook, Ill.; Dennis Tennant, Copley, Ohio

[73] Assignee: Sonoco Products Company, Hartsville, S.C.

[21] Appl. No.: 699,829

[22] Filed: May 14, 1991

[51] Int. Cl.[5] ..... B65D 85/66

[52] U.S. Cl. ..... 206/397; 206/408; 206/416

[58] Field of Search ..... 206/389, 397, 415, 416, 206/413, 408

[56] References Cited

U.S. PATENT DOCUMENTS

| | | | |
|---|---|---|---|
| 874,160 | 12/1907 | Buckborough | 206/416 |
| 2,625,317 | 1/1953 | MacChesney | 206/416 X |
| 4,997,086 | 3/1991 | Furukawa | 206/397 |

*Primary Examiner*—William I. Price

*Attorney, Agent, or Firm*—Dennison, Meserole Pollack & Scheiner

[57] ABSTRACT

A drum assembly for a wire coil comprising a paperboard drum with a paperboard bottom assembly including a bottom heading with a fixed length flexible strap extending diametrically thereacross and including an axially projecting loop. The loop is surrounded by an annular disc which overlies the end portions of the strap and is affixed to the bottom heading. The bottom heading assembly mounts to the lower open end of the drum. After the coil is received in the drum, the coil is overlaid by a diametrically extending bar which is compressively engaged against the upper end of the coil by an elastomeric cord engaged between the bottom strap loop and the bar.

18 Claims, 1 Drawing Sheet

WIRE COIL PACKAGE

BACKGROUND OF THE INVENTION

The packaging of wire is normally effected by the coiling of the wire, in a continuous length, within a cylindrical container or drum about a central core. Alternatively, the wire can be wound or coiled about a platform-supported rigid rack or reel.

A preferred manner of packaging wire, and one which is economically desirable, involves the use of a fiberboard or paperboard drum with a fiberboard or paperboard bottom heading and an inner core extending upward from the bottom heading and defining an annular space within the drum for receiving the wire coil.

In packing the drum, wire is drawn from a processing machine in a continuous operation and fed loosely into the drum as the drum is rotated. The wire does not actually wind on the inner core of the drum but falls loosely between the drum side wall and the core. Upon a depositing of the desired amount of wire within the drum, the drum is normally closed with a lid or top heading. Wire packaged in this manner is available for high or low speed dispensing at the point of use with the wire "paid off" from the coil. Wires packaged in this manner can include low and high carbon wires, high carbon steel wire, and magnet, plastic coated, brass, bronze and welding wires.

While paperboard, cardboard or like fiberboard drums are preferred, principally for reasons of economy in the cost of materials, ease of handing, and reduced shipping weight, problems occasionally arise from the tendency of the wire to shift within the drum during transit. This in turn can result in damage to the relatively lightweight container itself and can affect the structure of the coil and the ease in which the wire can be "paid out" from the packaged coil.

SUMMARY OF THE INVENTION

The present invention comprises a dunnage system which is specifically adapted for accommodation within a paperboard container to provide a constant compressive force on a received wire coil to maintain the coil stable within the drum and prevent shifting, particularly during transit.

Basically, the wire coil, after being formed within the drum, is retained by a flexible dunnage system which, anchored at the bottom or bottom heading, extends centrally through the coil and into overlying engagement therewith. The dunnage system includes elastomeric means for exerting a downward compressive clamping force on the upper end of the coil whereby any tendency for the wire to move is effectively resisted.

A major feature of the system is the bottom heading assembly comprising the bottom heading itself, an elongate fixed length strap fixed to the inner surface of the heading by staples or the like and including a vertically extending central loop, and, preferably, an annular disc, also of an appropriate pasteboard, overlying the inner surface of the bottom heading with the ends of the strap received therebetween and with the loop projecting through the central hole in the annular disc. Assembled in the above manner, the resultant assembly will be secured to the open lower end of the drum by a crimping of the bottom heading thereto in a conventional manner.

The dunnage or hold-down system is completed, subsequent to a coiling of the wire within the drum, by engaging the hooked lower end of an elastomeric member or strap to the vertically extending loop, stretching the elastomeric strap and inserting an elongate rigid bar through a loop or eye defined at the upper end of the elastomeric member whereby contraction of the elastomeric member will exert a constant compressive force on the upper end of the coil through the bar resting thereagainst. As desire, a load distributing and coil stabilizing disc can overlie the coil immediately below the bar. In addition, further stability to the packaged coil can be provided by the use of an internal core, the lower end of which will be received and glued within the central opening of the annular disc at the bottom assembly.

Additional details of construction, and advantages derived therefrom, will become apparent from the more complete description of the invention following hereinafter.

DESCRIPTION OF PREFERRED EMBODIMENTS

Figure 1:
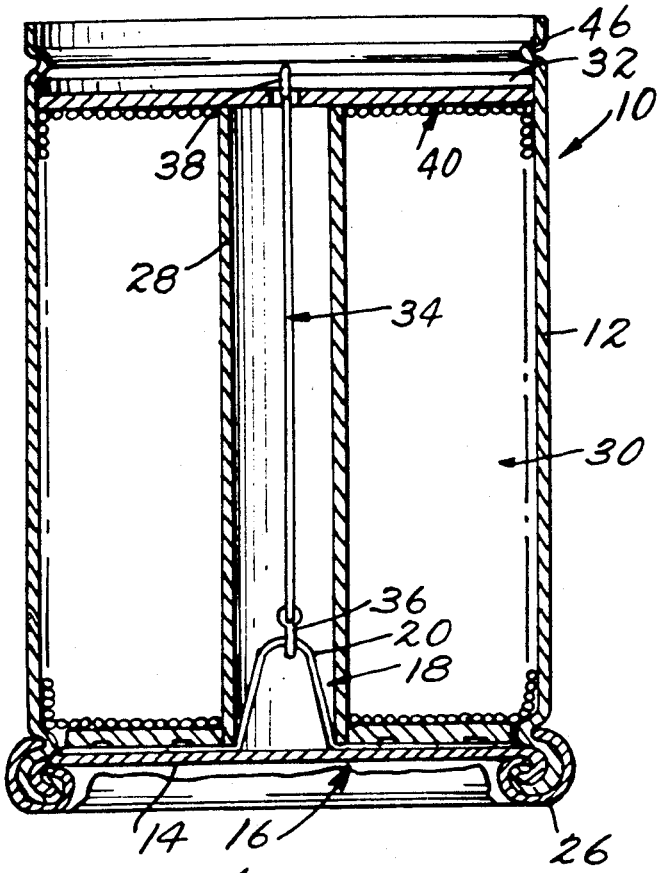
FIG. 1 is vertical cross-section through the drum assembly of the present invention with a wire coil mounted therein for transit.
Figure 2:
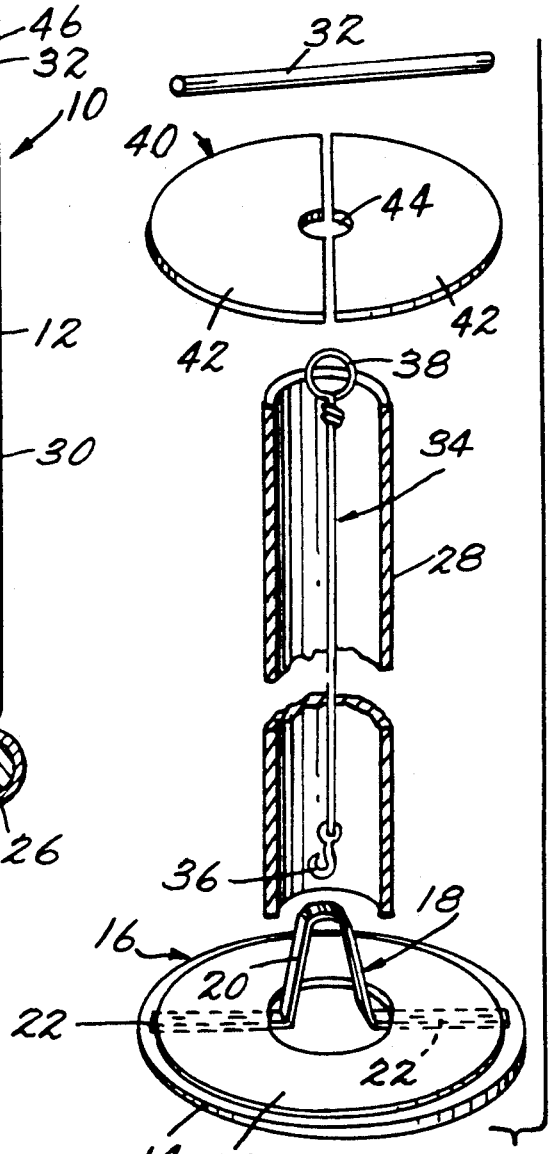
FIG. 2 is an exploded perspective view of the components of the coil hold-down and stabilizing system.
Figure 3:
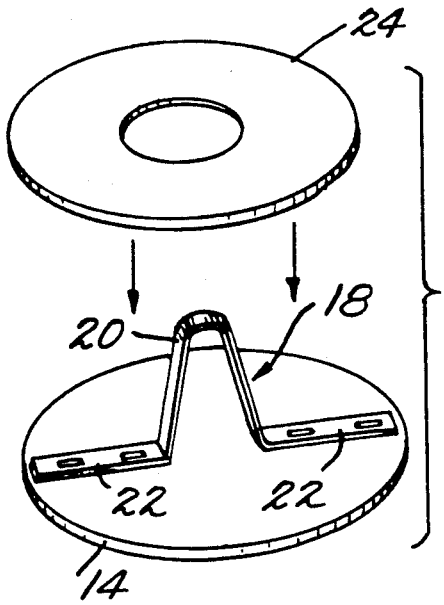
FIG. 3 is an exploded perspective view of the bottom heading assembly.

Referring now more specifically to the drawings, the drum assembly 10 includes a drum body 12, preferably defined by a cylindrical wall and formed of an appropriate pasteboard material such as convolutely wound kraft paper to define a rigid yet inexpensive and structurally stable unit.

The lower end of the drum is closed by a bottom or bottom heading 14, similarly of a pasteboard construction and edge-mounted to the lower edge portion of the drum body 12 in a conventional manner, as by crimping or the like.

The bottom heading 14 is the base component of the unique bottom heading assembly 16 of the invention. This bottom assembly, in addition to the bottom heading 14 itself, includes a fixed-length strap 18 formed to define a central vertically projecting loop 20 and oppositely directed elongate lower end portions 22. The elongate end portions 22 engage the upper or inner surface of the bottom heading 14 on a diameter and projects radially outward in opposite directions from the center of the bottom heading 14. The loop 20, in turn, extends vertically upward in axial alignment with the bottom heading 14.

The strap 18 is preferably an elongate fixed length flexible member, as for example plastic banding, possessing high strength and a capability of maintaining the shape of the upwardly projecting central loop 20 upon securement of the outwardly directed lower end portions or lengths 22 to the upper surface of the bottom heading 14. It is contemplated that the lower end portions 22 be secure to the bottom heading 14 by staples at one or more points along the length of each end portion between the loop and the outer peripheral edge of the bottom heading 14. Other securement means may be used as might accommodate the pasteboard construction of the bottom heading and the flexible strap.

The bottom heading assembly is completed by an annular disc 24, also preferably of pasteboard construction, which is received over and glued to the upper face of the bottom heading 14 with the radially extending end portions 22 of the strap 18 received therebetween. The annular disc 24 will preferably be slightly diametrically smaller than the bottom heading 14 to allow for securing of the bottom heading assembly to the open lower end of the drum 12 by edge crimping or the like, as suggested at 26.

With the bottom heading assembly 16 mounted to the drum, the loop 20 of the securing strap 18 projects vertically upward along the central axis of the drum for a minor portion of the height thereof sufficient to allow access from the open upper end of the drum as shall be referred to subsequently. The drum is now prepared to receive the wire which will normally be drawn from a processing machine in a continuous operation and fed loosely into the drum as the drum is rotated. The wire coils into the drum about the central axis thereof. It is preferred that a vertically elongate central tubular core 28, also of appropriate pasteboard material, be provided in the drum to assist in the reception and placing of the introduced wire and a stabilization of the coil when completely wound. The core 28 will normally have the lower end thereof received within and bonded to the periphery of the inner opening of the lower annular disc 24.

After the wire has been coiled into the drum 12, and the wire coil 30 completely formed, the hold-down system is completed by the provision of dunnage in the nature of a rigid bar 32 of a length to extend diametrically across the interior of the drum 12 and in directly engaging overlying relation to the top of the coil 30. It is preferred that the length of this bar 32 be only slightly less than the internal diameter of the drum so as to be readily inserted into the drum and capable of overlying substantially the full diametric extent of the coil.

The bar is secured to the strap loop 20 and is adapted to provide continuous compressive engagement with the coil by a tensioned elastomeric strap or cord 34. The lower end of the cord 34 is provided with an upwardly opening hook 36 which, through the open upper end of the drum and the central core 28, is easily hooked to the strap loop 20. The upper end of the cord 34 includes appropriate means, for example an integrally formed close loop eye 38, centrally engaging the overlying bar 32. The length of the cord 34 is such whereby a positive tensioning thereof is required to extend between the bottom strap loop 20 and the upper bar 32 with the actual strength and tensioning of the cord 34 being such as to effect a positive downward compressive force on the coil 30 sufficient to stabilize the coil and keep the wire from shifting, unwinding, or the like particularly during transit of the drum assembly.

As will be appreciated, the coil itself seats on the lower strap end portions 22, either directly or through the overlying annular disc 24, thus further stabilizing the lower strap 18 as an anchoring means for the elastomeric cord 34.

Further, in order to enhance the function of the hold-down bar 32, a top disc 40, normally formed in two half or semicircular sections 42, can be provided, the disc 40 having a central aperture 44 for reception of the elastomeric cord 34 therethrough. This top disc 40, of an appropriate structurally stable material, for example pasteboard or a suitable synthetic resin, will transmit or distribute the compressive force of the bar 32 throughout the entire upper surface of the coil 30 for a more uniform stabilization of the coil.

As suggested in FIG. 1, the formation of the top hold-down disc 40 in two sections 42 enables the disc to closely conform to the interior of the drum above the coil 30 and below the inwardly extending rib 46 normally defined about the interior of the drum wall adjacent the mouth end thereof as or in conjunction with the conventional formation of this end with a protective chime or the like. By formation of the disc 40 in two sections, each section or disc half can be introduced separately and subsequently aligned on the upper end of the coil for engagement by the overlying bar 32.

The drum assembly, after securement of the coil therein, can be sealed by an appropriate top heading clamped thereto in a conventional manner.

From the foregoing, it will be appreciated that a unique dunnage system has been provided for the positive securement of a wire coil within a pasteboard package or drum assembly utilizing both a pasteboard wall or container body and a pasteboard bottom closure As previously noted, the drum body will preferably be formed of convolutely wound kraft paper.

A significant feature of the hold-down system employed is the bottom heading assembly which incorporates means for anchoring the entire hold-down system, notwithstanding the pasteboard nature thereof.

The foregoing is considered illustrative of the principals of the invention, and it is not desired to limit the construction to the exact construction shown and described. Rather, the invention is only to be limited by the scope of the claims following hereinafter.

We claim:

1. In a drum assembly for a wire coil comprising a pasteboard drum with upper and lower ends, and a pasteboard bottom secured to and across said lower end; hold-down means for a drum-received wire coil, said hold-down means being centrally positioned in said drum, said drum defining a generally annular space outward of said hold-down means for the reception of a wire coil therein about said hold-down means, said hold-down means including a lower end portion overlying said bottom and extending generally diametrically therealong and at least partially across said space to underlie a drum-received wire coil, means securing said lower end portion to said bottom, said hold-down means further including a rigid upper end portion positionable to overlie a drum-received wire coil, and elastomeric means engaged between said lower end portion and said upper end portion for resiliently biasing said upper end portion toward said lower end portion and with a compressive force against a drum-received coil therebetween.

2. The drum assembly of claim 1 wherein said lower end portion of said hold-down means comprises an elongate strap having a central loop extending upwardly from said bottom centrally within said drum, and a pair of opposed elongate strap ends extending laterally from said loop and across said space.

3. The drum assembly of claim 2 including an annular disc overlying said strap ends around said central loop and defining a base for a drum-received coil.

4. The drum assembly of claim 3 wherein said annular disc is adhesively secured to said bottom.

5. The drum assembly of claim 4 wherein said elongate strap is of a fixed length.

6. The drum assembly of claim 3 wherein said rigid upper end portion of said hold-down means comprises an elongate rod positionable diametrically across a drum-received coil.

7. The drum assembly of claim 6 including rigid disc means immediately below said elongate rod for distribution of the compressive force of said upper end portion to a drum-received coil annularly thereabout.

8. The drum assembly of claim 7 wherein said elongate strap is of a fixed length.

9. The drum assembly of claim 8 wherein said annular disc is adhesively secured to said bottom.

10. The drum assembly of claim 3 wherein said annular disc includes an inner periphery defining a central opening receiving said central loop therethrough, and an elongate cylindrical core having a lower end received within said central opening of said annular disc and extending vertically therefrom about said central loop and for a substantial portion of the height of the drum.

11. A bottom assembly for a container used in the packaging of a wire coil, said bottom assembly comprising a bottom heading, a strap overlying and extending diametrically across said bottom heading, said strap having elongate oppositely directed end portions contacting said heading, and an intermediate portion comprising a loop extending laterally from said bottom heading centrally thereof for anchoring a hold-down system for a container-received wire coil, and means for fixing said end portions to said bottom heading.

12. The bottom assembly of claim 11 wherein said bottom heading is formed of pasteboard.

13. The bottom assembly of claim 11 including an annular disc surrounding said loop and overlie said bottom heading with said end portions therebetween, and means for fixing said annular disc to said bottom heading.

14. The bottom assembly of claim 13 wherein said means for fixing said annular disc to said bottom heading is an adhesive bond.

15. The bottom assembly of claim 14 wherein said strap is flexible and of a fixed length.

16. The bottom assembly of claim 15 wherein said means for fixing said end portions to said bottom heading comprise staples.

17. The bottom assembly of claim 16 wherein said bottom heading is formed of pasteboard.

18. The bottom assembly of claim 12 wherein said strap is flexible and of a fixed length.

* * * * *